US006695597B2

(12) United States Patent
Kimura et al.

(10) Patent No.: US 6,695,597 B2
(45) Date of Patent: Feb. 24, 2004

(54) SCROLL FLUID MACHINE

(75) Inventors: Hideyuki Kimura, Kanagawa-ken (JP); Atushi Fukui, Kanagawa-ken (JP); Ken Yanagisawa, Kanagawa-ken (JP); Toshihiro Honma, Kanagawa-ken (JP)

(73) Assignee: Anest Iwata Corporation, Tokyo (JP)

( * ) Notice: Subject to any disclaimer, the term of this patent is extended or adjusted under 35 U.S.C. 154(b) by 0 days.

(21) Appl. No.: 09/799,099

(22) Filed: Mar. 6, 2001

(65) Prior Publication Data

US 2001/0038800 A1 Nov. 8, 2001

(30) Foreign Application Priority Data

Mar. 6, 2000 (JP) ..... 2000-061262

(51) Int. Cl.[7] ..... F03C 02/00
(52) U.S. Cl. ..... 418/55.2; 418/55.4; 418/142
(58) Field of Search ..... 418/55.2, 55.4, 418/142

(56) References Cited

U.S. PATENT DOCUMENTS

| | | | | | |
|---|---|---|---|---|---|
| 4,494,914 | A | * | 1/1985 | Shiibayashi | 418/55.4 |
| 4,627,800 | A | * | 12/1986 | Matsudaira et al. | 418/55.2 |
| 4,802,831 | A | * | 2/1989 | Suefuji | 418/55.2 |
| 5,366,358 | A | | 11/1994 | Grenci et al. | |
| 5,632,612 | A | * | 5/1997 | Shaffer | 418/55.4 |
| 5,759,020 | A | * | 6/1998 | Shaffer | 418/55.4 |
| 5,823,756 | A | * | 10/1998 | Kawazoe | 418/55.4 |
| 6,224,357 | B1 | * | 5/2001 | Komai | 418/55.2 |

FOREIGN PATENT DOCUMENTS

| | | | | |
|---|---|---|---|---|
| DE | 4200530 | * | 7/1992 | 418/55.4 |
| DE | 19842050 | | 4/2001 | |
| EP | 124114 | * | 11/1984 | 418/55.4 |
| EP | 0743454 | | 11/1996 | |
| JP | 05-087065 | * | 4/1993 | 418/55.4 |
| JP | 06-207588 | * | 7/1994 | 418/55.4 |
| JP | 7208353 | | 8/1995 | |
| JP | 11-062858 | * | 3/1999 | 418/55.4 |

* cited by examiner

*Primary Examiner*—Thomas Denion
*Assistant Examiner*—Theresa Trieu
(74) *Attorney, Agent, or Firm*—Crowell & Moring LLP

(57) ABSTRACT

A scroll fluid machine has a stationary scroll and a revolving scroll, each of which has a spiral scroll wrap spiraling from the center side to the outer side. One of the scrolls has an annular outermost wrap having a radius larger than that at the outer end of the spiral wrap of the other scroll. The annular, outermost wrap is the outermost wall, and the scrolls are assembled so that the wrap of the other scroll is disposed in the inner side of the wrap of the one of the scrolls.

6 Claims, 12 Drawing Sheets

SECTION D–D
SECTION D'–D'
(SECTION D″–D″)

SECTION D–D
SECTION D'–D'
(SECTION D″–D″)

CROSS SECTION OF SEAL ELEMENT 46A IS CIRCULAR

CROSS SECTION OF SEAL ELEMENT 46B IS CIRCULAR OR HOLLOW OCTAGONAL

SCROLL FLUID MACHINE

BACKGROUND OF THE INVENTION

1. Field of the Invention

The present invention relates to a scroll fluid machine which performs compression, expansion, and pressure feeding, specifically a scroll fluid machine of which the outermost wrap of either of the stationary or revolving scroll which is larger in diameter is formed into an annular shape to form the outermost wall of an enclosing body for taking in fluid to be compressed.

2. Description of the Related Art

A scroll fluid machine having a stationary scroll and a revolving scroll is well known. Art disclosed in Published Unexamined Patent Application No. Hei-7-208353 is one. According to this art, as shown in FIG. 12, a stationary scroll 106 has a space 108 and a wrap 100, an annular groove 122 is formed on the mating face 121 of the stationary scroll 106, an elastic element 127 and a seal element 123 are arranged in the annular groove 122, and a revolving scroll 107 revolves while its mirror surface slides on the seal element 123.

The portion 121B of the mating face 121 is essentially not needed for taking in and compressing fluid. The mirror surface of the revolving scroll 107 is required to be extended over the portion 121B of the mating face 121, which leads to a larger diameter of the revolving scroll. The width of the mating face 121 of the stationary scroll is enough as long as the annular groove 122 can be formed with narrow rims on both sides of the annular groove 122 remaining.

According to the prior art, therefore, there remains an essentially not necessary, not slimmed portion, which hinders downsizing of the scroll fluid machine.

On the other hand, in order to achieve a high compression ratio, or a high pressure ratio in the case of a scroll compressor, the number of turns of scroll wraps is to be increased, and to shorten the time for evacuating a vessel in the case of a scroll vacuum pump, the suction volume of fluid is to be increased. To achieve high compression ratio or to shorten the time for evacuation, the revolving radius of the revolving scroll is required to be increased, leading to enlarged outer dimensions of the scroll fluid machine.

However, the space 108 is to be expanded in order to meet the requirements for using the prior art, which leads to an increased revolving radius of the revolving scroll and increased friction of the seal element 123, for the seal element 123 is to be lengthened owing to increased diameter of the annular groove. Further, for achieving a high compression ratio, the arrangement of a seal element between each of the top faces of the wraps and each of the mating sliding surfaces is necessary to prevent the leakage of compressed fluid from a compression chamber higher in pressure to that lower in pressure in the process of compression, the chambers being formed by the wraps of the revolving scroll and stationary scroll. The lengths of these seal elements are increased as the dimensions of the scroll fluid machine increase, and the friction by the seal elements also increases.

SUMMARY OF THE INVENTION

The present invention is done in the light of problems cited above. An object of the invention is to provide a scroll fluid machine capable of being small sized.

Another object of the invention is to provide a scroll fluid machine capable of achieving high compression ratio or high pressure ratio without enlarging the outer dimensions of the scroll machine.

A still further object of the invention is to provide a scroll fluid machine capable of preventing the increase of load by friction when the achievement of a high compression ratio is intended.

A yet further object of the invention is to provide a scroll fluid machine capable of saving the usage of the materials of scrolls, seal elements, etc.

The present invention is a scroll fluid machine having a stationary scroll and a revolving scroll, each scroll having a spiral scroll wrap spiraling from the center side to the outer side, one of the scrolls having an annular, outermost wrap of which the radius is larger than that at the outer end of the spiral wrap of the other scroll. The annular, outermost wrap is the outermost wall, and the scrolls are assembled so that the wrap of the other scroll is disposed in the inner side of the of the said one of the scrolls.

According to the invention, either one of the stationary or revolving scroll, each scroll having a spiral scroll wrap spiraling from the center side to the outer side, is provided with an annular, outermost wrap. The radius of the outermost wrap is larger than that at the outer end of the spiral wrap of the other scroll, and the outermost wrap forms the outermost wall of the said one of the scrolls, so the outermost wall has no excess width of rims as is the case with the prior art. The one and the other scrolls are assembled so that the wrap of the said other scroll is disposed in the inner side of the wrap of the said one of the scrolls. Therefore, the scroll mechanism becomes small sized, and the downsizing of the scroll fluid machine is achieved.

Accordingly, the light weight of the constituent elements of the scroll fluid machine is achieved, the load for driving the scroll mechanism is lightened, and the power for driving the scroll fluid mechanism is reduced.

Thus, a higher compression ratio or a higher pressure ratio is achieved with the same dimensions of the scroll fluid machine as in the prior art.

Also, the present invention is a scroll fluid machine having a stationary scroll and a revolving scroll, each scroll having a spiral scroll lap spiraling from the center side to the outer side, one of the scrolls having an annular, outermost wrap with the diameter larger than the outer end of the spiral wrap of the other scroll. The annular outermost wrap is the outermost wall, and the scrolls are assembled so that the wrap of the other scroll is disposed in the inner side the one of the scrolls. A seal element for sliding surface sealing which contacts with the mating sliding surface is provided on the outermost wrap.

According to the invention cited above, each of the seal elements provided on the wraps of the stationary and revolving scrolls slides on each mating sliding surface to keep the chambers formed toward both sides of the wrap sealed, so the leakage of the compressed fluid from a compression chamber higher in pressure to that lower in pressure is prevented, and high compression ratio, or high pressure ratio, can be achieved.

According to this second invention, as in the first invention, either one of the stationary or revolving scroll, each scroll having a spiral scroll wrap spiraling from the center side to the outer side, is provided with an annular, outermost wrap. The radius of the outermost wrap is larger than that at the outer end of the spiral wrap of the other scroll, and the outermost wrap forms the outermost wall of the said one of the scrolls, so the outermost wall has no excess width of rims as is the case with the prior art. The one and the other scrolls are assembled so that the wrap of the said other scroll is disposed in the inner side of the wrap of the said one of the scrolls. Therefore, the scroll mechanism becomes small sized, and the downsizing of the scroll fluid machine is achieved.

Further, as a seal element for sliding surface sealing which contacts with the mating sliding surface is provided on the outermost wrap, the seal element for sliding surface sealing on the outermost wrap achieves the role of sealing dust while at the same time achieving the sealing of fluid without providing an extra dust seal still outside of the outermost wrap.

Accordingly, the light weight of the constituent elements of the scroll fluid machine is achieved, the load for driving the scroll mechanism is lightened, and the power for driving the scroll fluid mechanism is reduced.

Thus, a higher compression ratio or a higher pressure ratio is achieved with the same dimensions of the scroll fluid machine of the prior art.

As the outermost wrap achieves the role of the outermost wall, it is required to use a dust seal having superior resistance to wear, but a seal with superior resistance to high temperature and high pressure is not required.

It is also an effective means of the present invention to compose the outer side end of the spiral wrap of the said one of the scrolls so that it connects with the outermost wrap at a connecting part formed at the partway of the of the outermost. A chip seal is provided on the wrap of the said one of the scrolls from the center side end till the connecting part, and a dust seal is provided on the outermost wrap, the dust seal working as a slide surface seal element of the outermost wrap.

The slide surface seal element is required to be a dust seal having superior resistance to wear but is not required to be a seal with superior resistance to high temperature and high pressure.

It is also an effective means of the above-cited second invention to compose a scroll fluid machine so that the outermost wall is a first outer wall which has an outer side end part on a scroll wrap of the said one of the scrolls and a beginning part at a certain length toward the center, and a second outer wall which extends in the direction of the circumference from the outer side end to form a fluid taking-in chamber for taking in fluid and joins with the beginning part. A chip seal is provided on the wrap of the said one of the scrolls from the center side till the outer side end, and a dust seal is provided on the second outer wall, the dust seal and the chip seal working as sliding surface seal element.

According to the technical means cited above, it is. possible to select a dust seal having superior resistance to wear for the second outer wall which confines the take-in chamber for taking in fluid from outside, and to select a chip seal having superior resistance to high temperature and pressure for the first outer wall of which the temperature becomes higher than that of the second outer wall. Therefore, excessive quality of the seal material is evaded, which is economical and contributes to the development of industry.

As the first outer wall is the extension of the spiral wrap, the same chip seal is used for the first outer wall and the spiral wrap, and the assembling process is simplified.

It is effective to compose the present invention so that the outer side end of the spiral wrap of the said one of the scrolls connects with the outermost wrap at a connecting part formed at the partway of the of the outermost wrap, and a chip seal is provided on the wrap of the said one of the scrolls from the center side end all over the outermost wrap, the chip seal working as a slide surface seal element of the outermost wrap.

According to the technical art cited above, as the same chip seal is provided on the spiral wrap and outermost wrap, the groove shape is the same on the spiral wrap and on the outermost wrap, which simplifies the machining process of the grooves.

It is also an effective means of the second invention that the chip seal is shaped so that the thickness i.e., the dimension in the direction of the depth of the groove, becomes greater from the outer side toward the center side of the scroll.

The thermal expansion of the chip seal is greater in the center side because of higher temperature, and the contact pressure of the chip seal to the sliding surface increases, leading to increased wear. By increasing the thickness of the chip seal toward the center side, its longevity is increased.

It is effective to compose the present invention so that a chip seal, on the outer side of which is provided a groove wall seal element exerting elastic force between the chip seal and the outer side wall of the chip seal groove formed on the scroll wrap, is disposed in the chip seal groove.

As the pressure in an enclosed space formed toward the outer side of a wrap is lower than that formed toward the inner side of the wrap, the chip seal is pressed outward. By providing the groove wall seal element between the chip seal and the outer side wall of the chip seal groove, even if a gap develops between the groove wall and the side face of the chip seal in the higher pressure side, and between the lower face of the chip seal and the bottom face of the groove, a leak of the fluid is prevented by the groove wall seal element.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only and not as limitative of the scope of the present invention.

Figure 1:
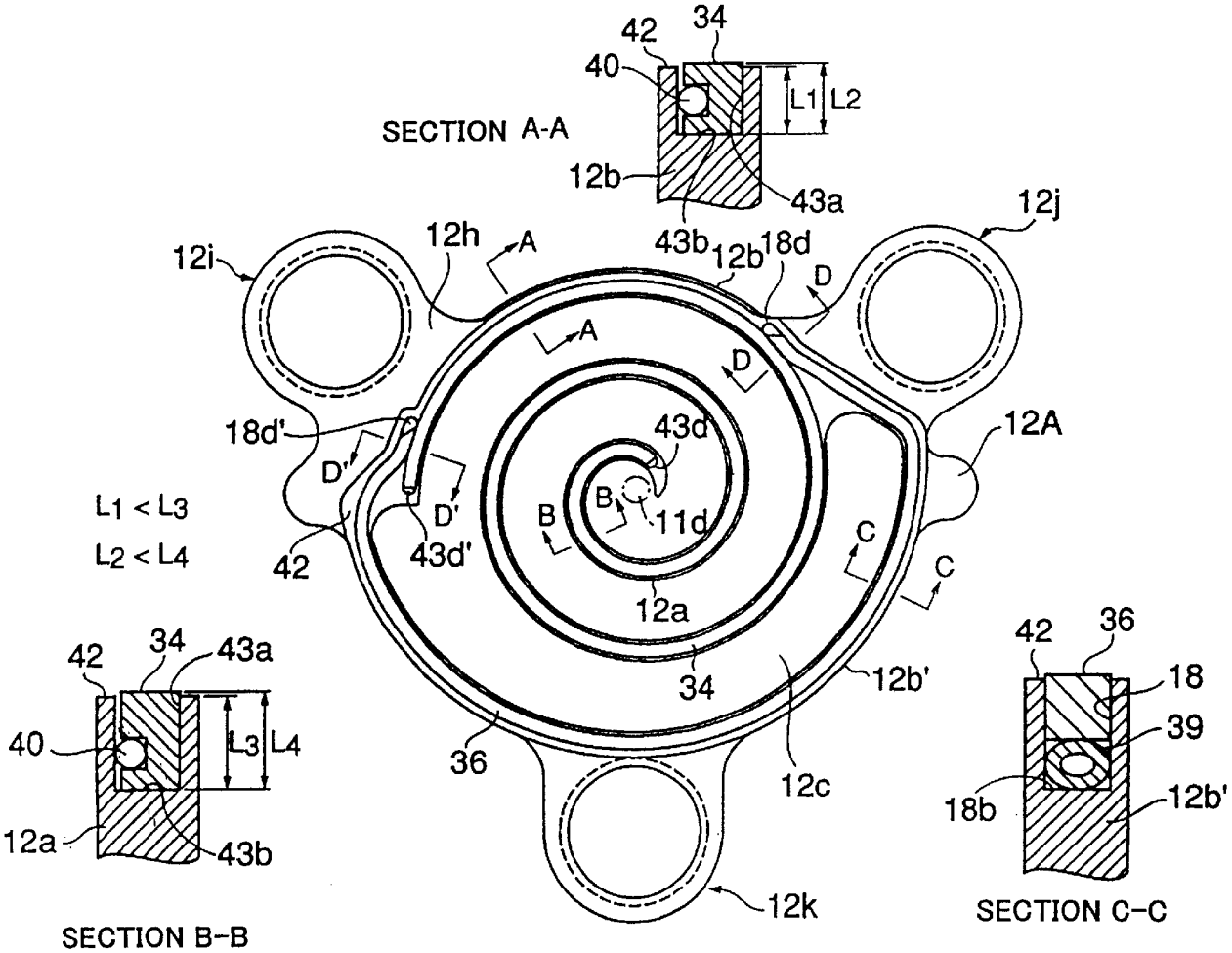
FIG. 1 is a schematic plan view of a first embodiment of the revolving scroll according to the present invention.
Figure 2A:
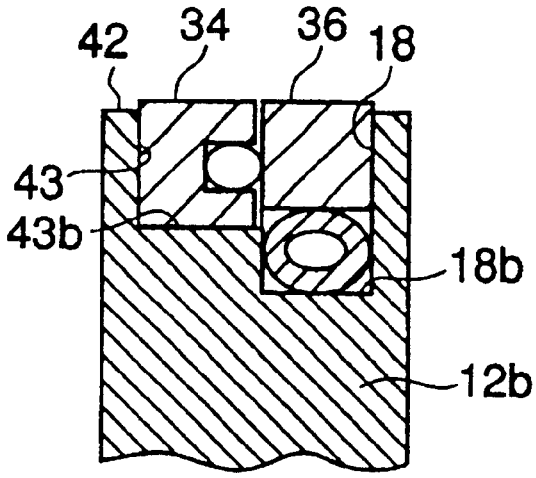
FIG. 2 illustrates cross-sectional views along line D—D and line D'—D' in FIG. 1.
Figure 2B:
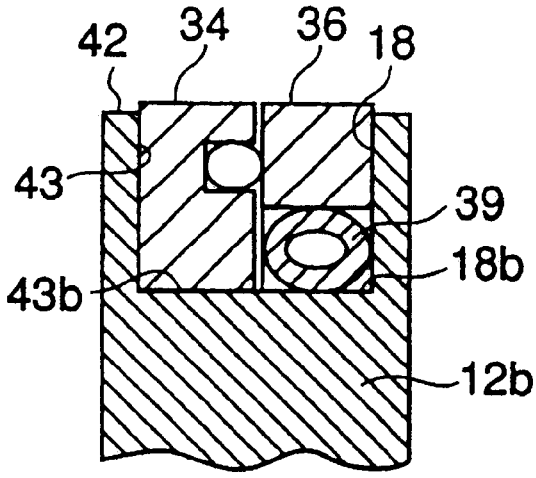
Figure 3A:
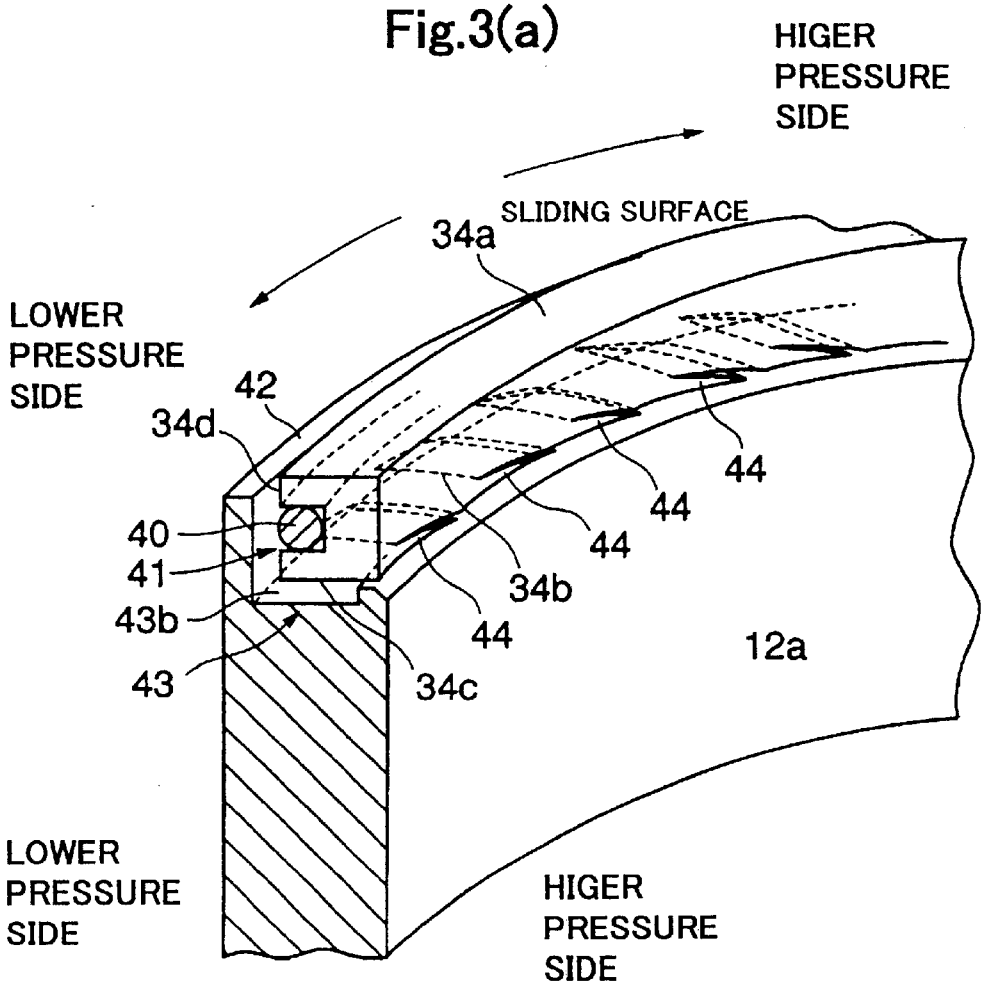
FIG. 3 illustrates a chip seal disposed in a chip seal groove.
Figure 3B:
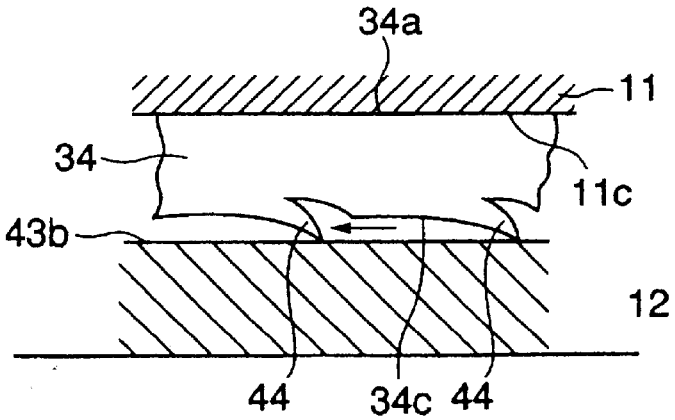
Figure 4:
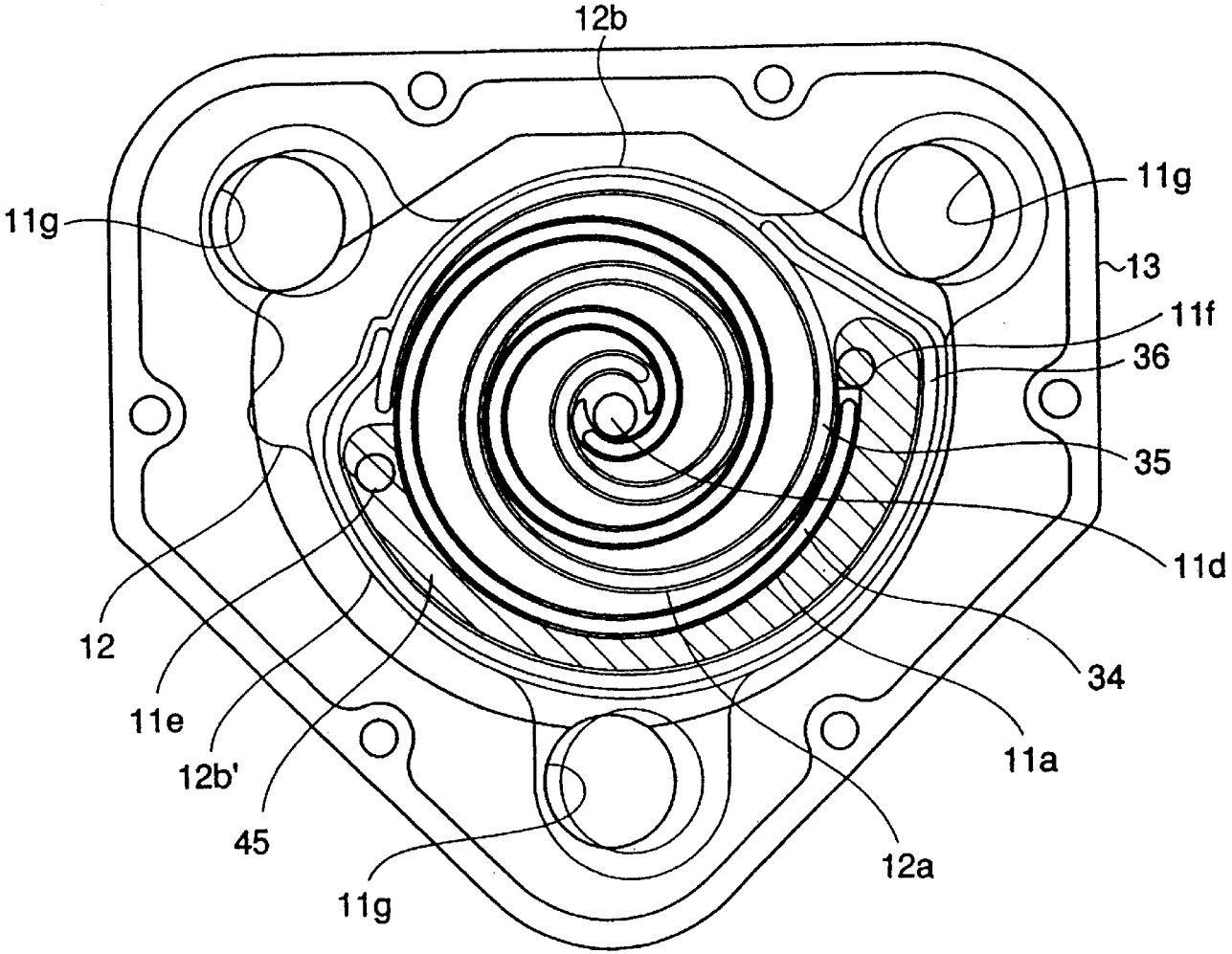
FIG. 4 illustrates a meshing state of a revolving scroll wrap and stationary scroll wrap.
Figure 5A:
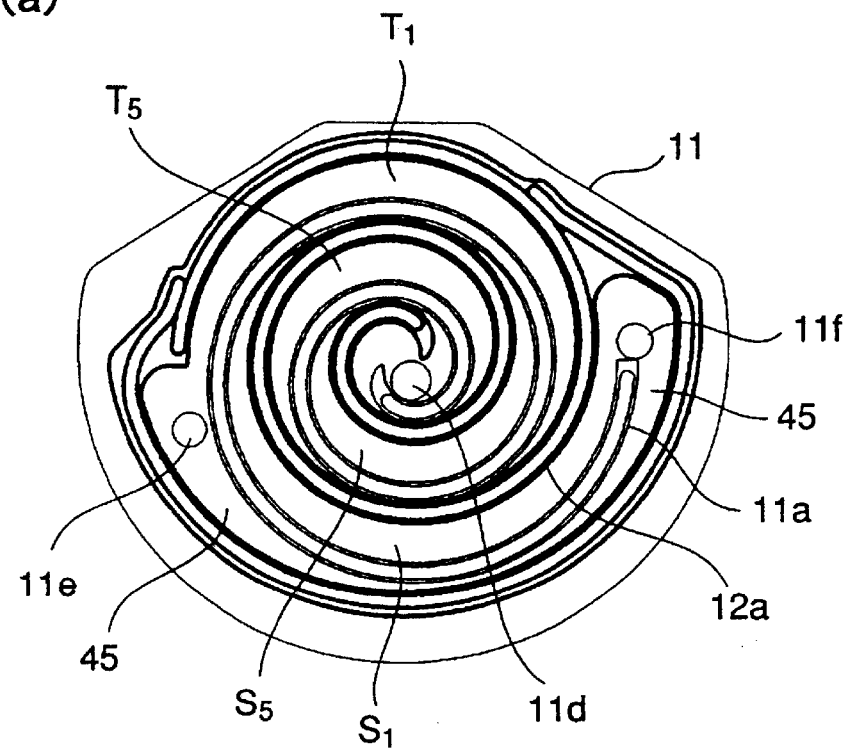
FIG. 5 illustrates meshing states for explaining the compression process by the revolving scroll and stationary scroll.
Figure 5B:
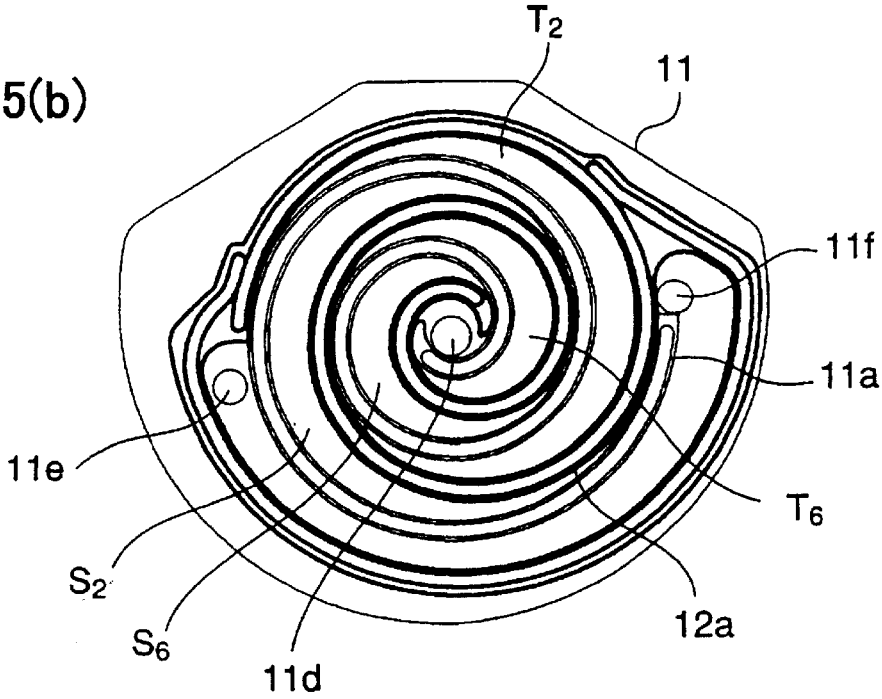
Figure 6A:
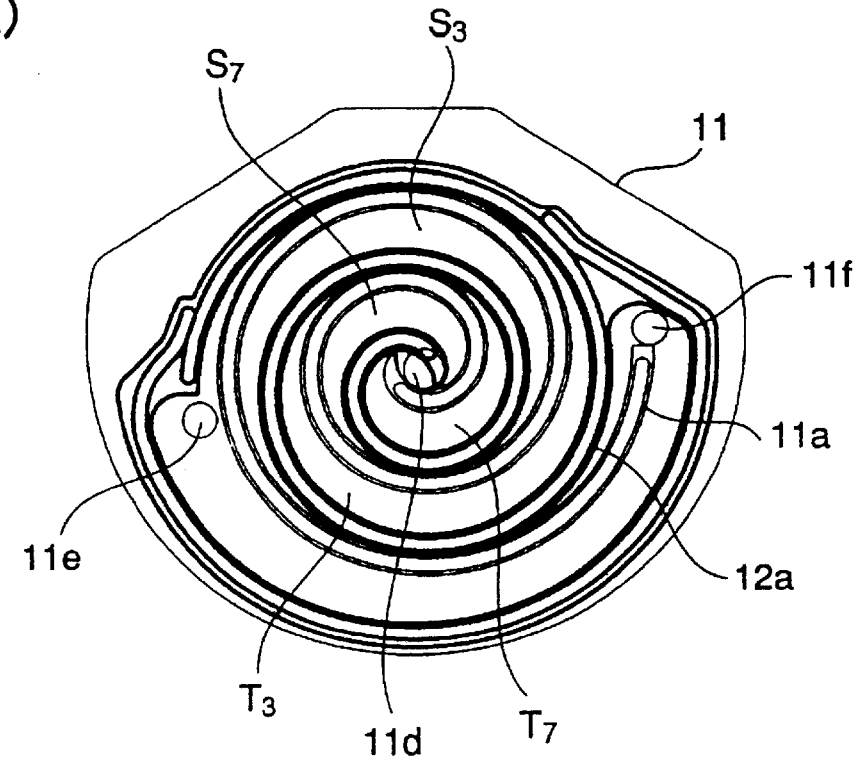
FIG. 6 illustrates meshing states for explaining the compression process by the revolving scroll and stationary scroll.
Figure 6B:
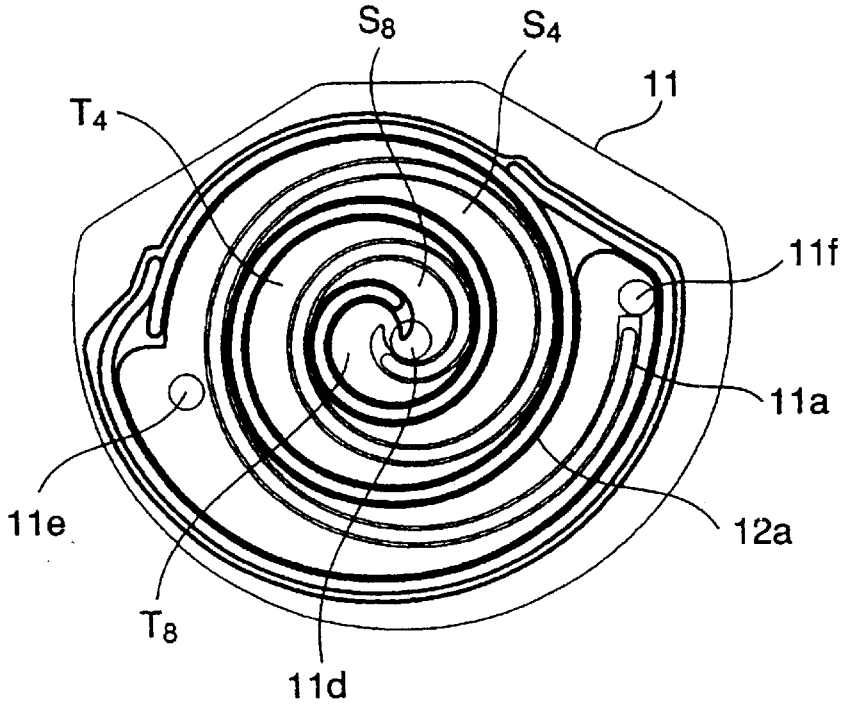
Figure 7:
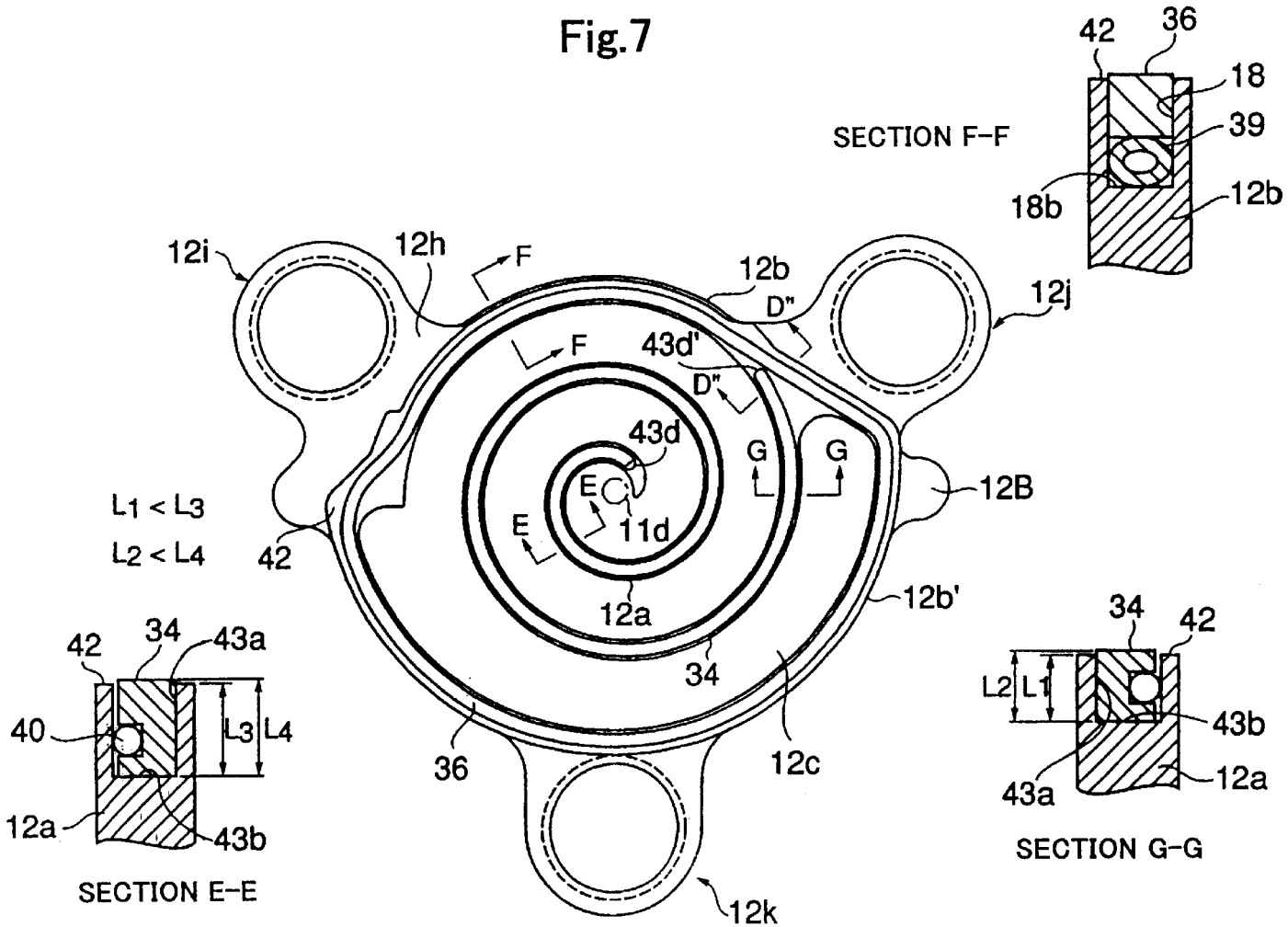
FIG. 7 is a schematic plan view of another embodiment of the revolving scroll according to the present invention.
Figure 8:
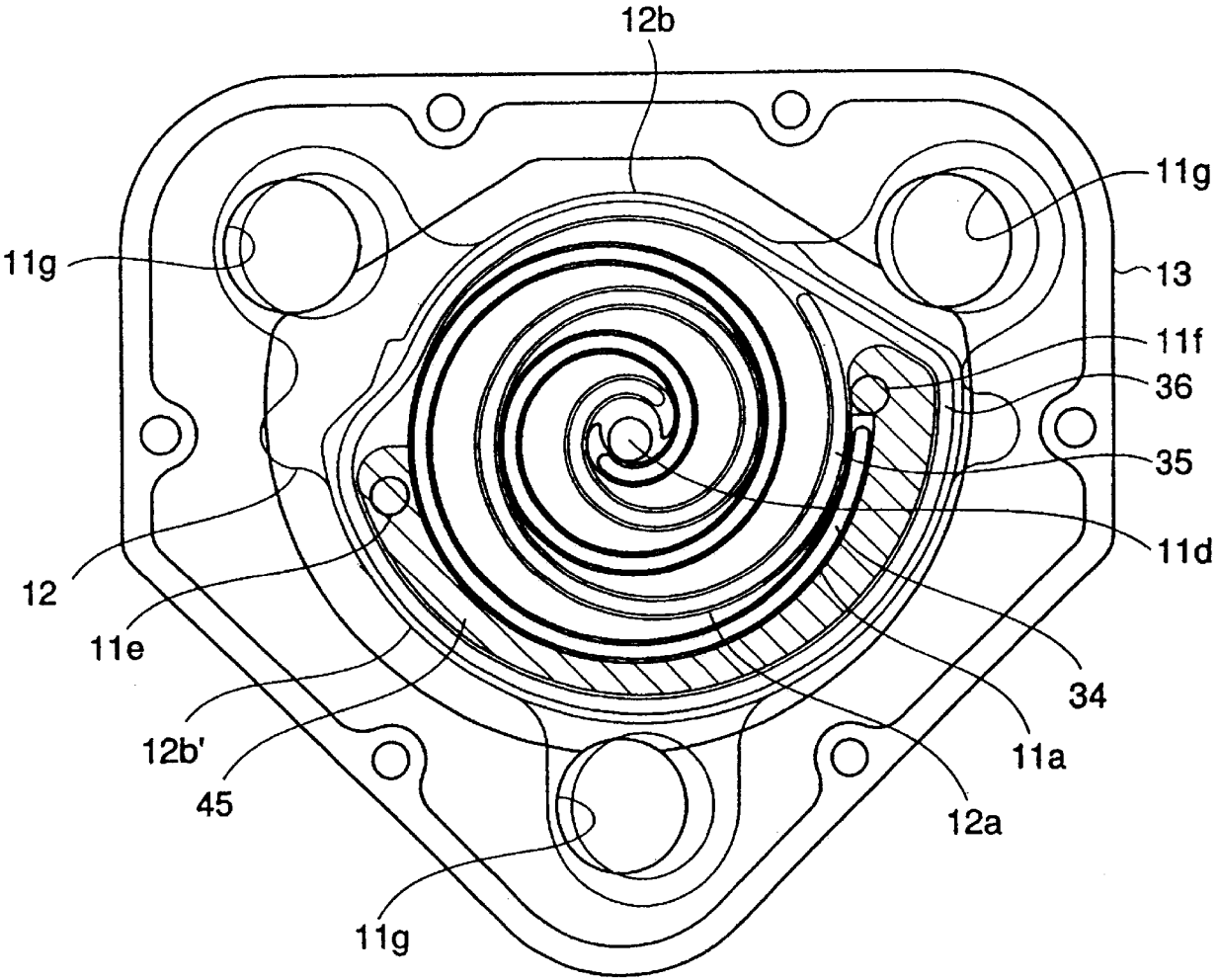
FIG. 8 illustrates a meshing state of a revolving scroll wrap and stationary scroll wrap.
Figure 9A:
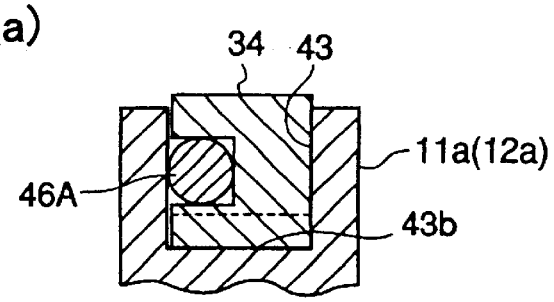
FIG. 9 illustrates a chip seal of another embodiment disposed in a chip seal groove.
Figure 9B:
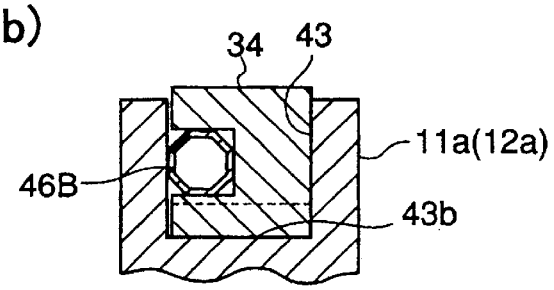
Figure 9C:
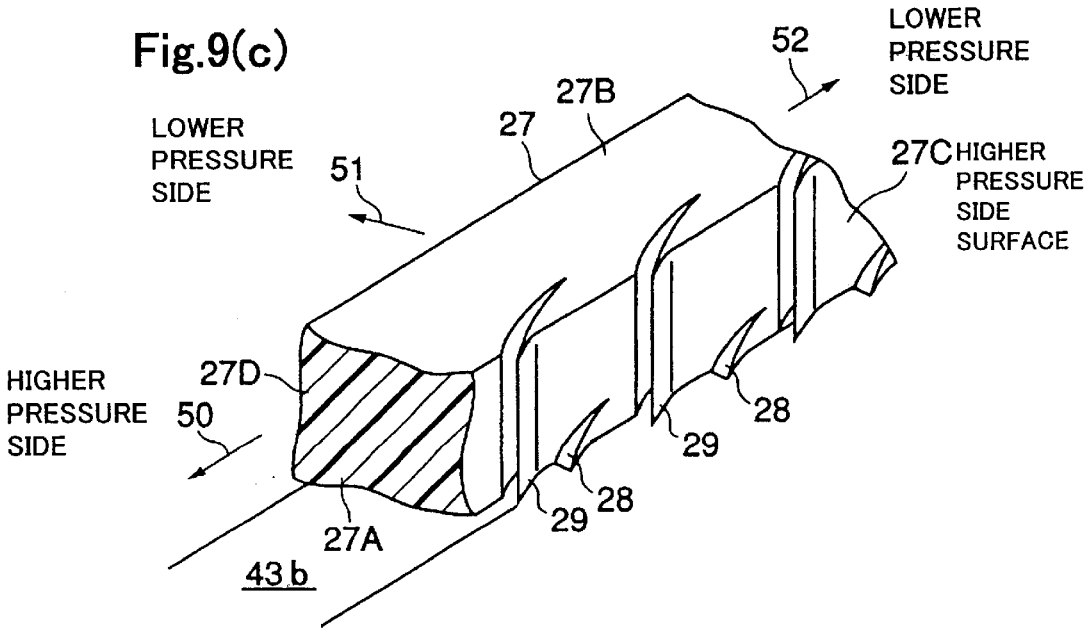
Figure 10:
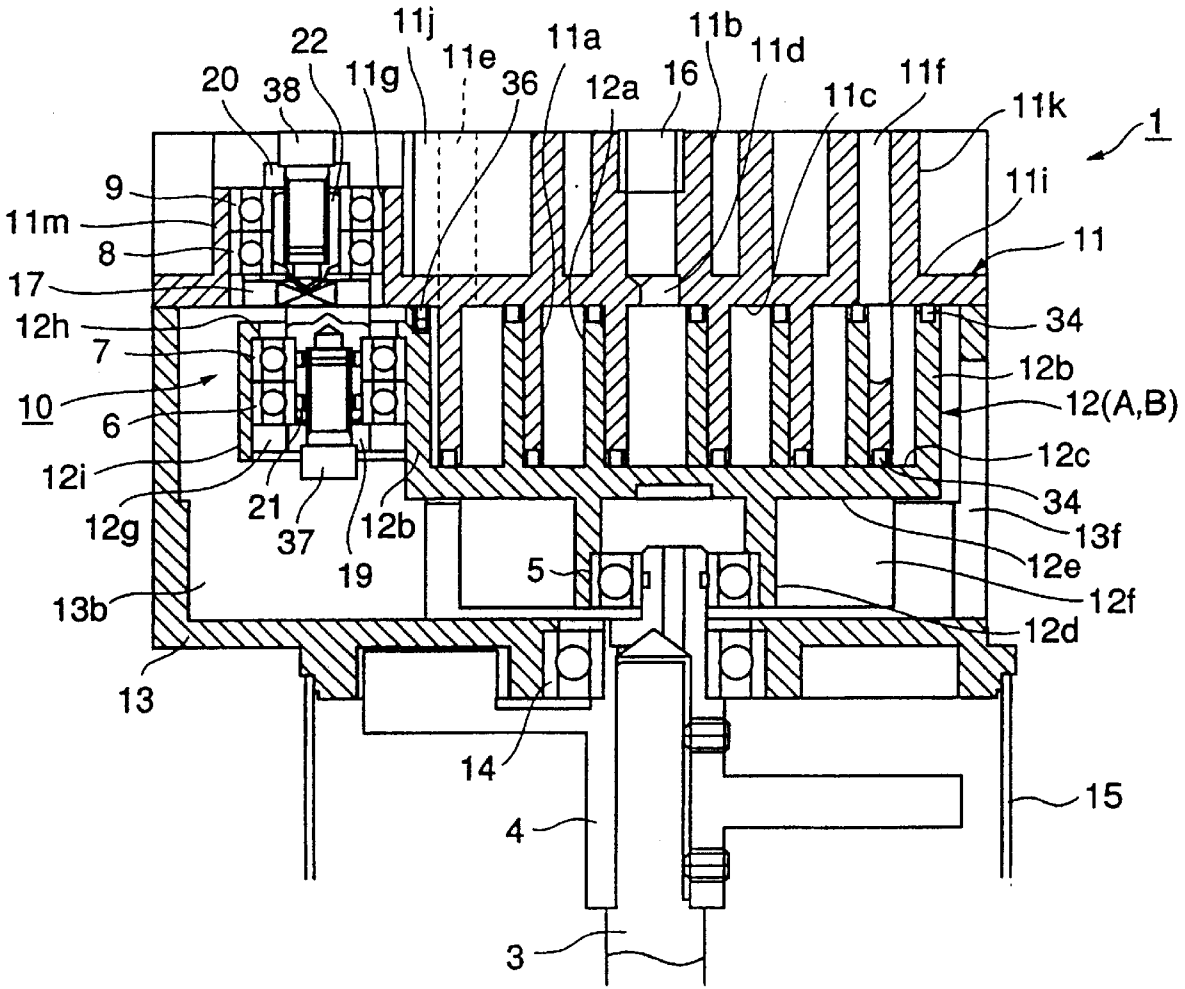
FIG. 10 is a cross-sectional view of a scroll fluid machine.
Figure 11:
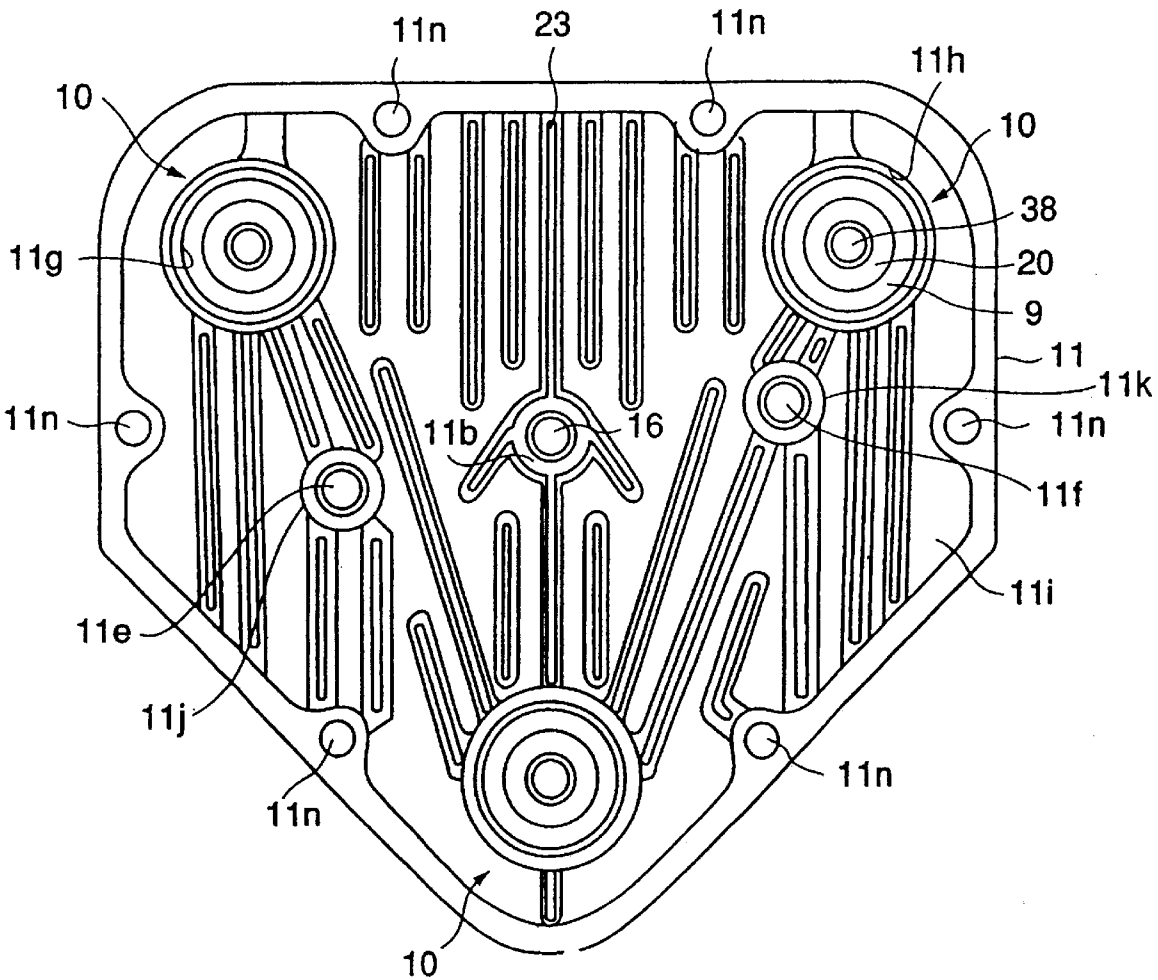
FIG. 11 is a plan view of a scroll fluid machine.
Figure 12A:
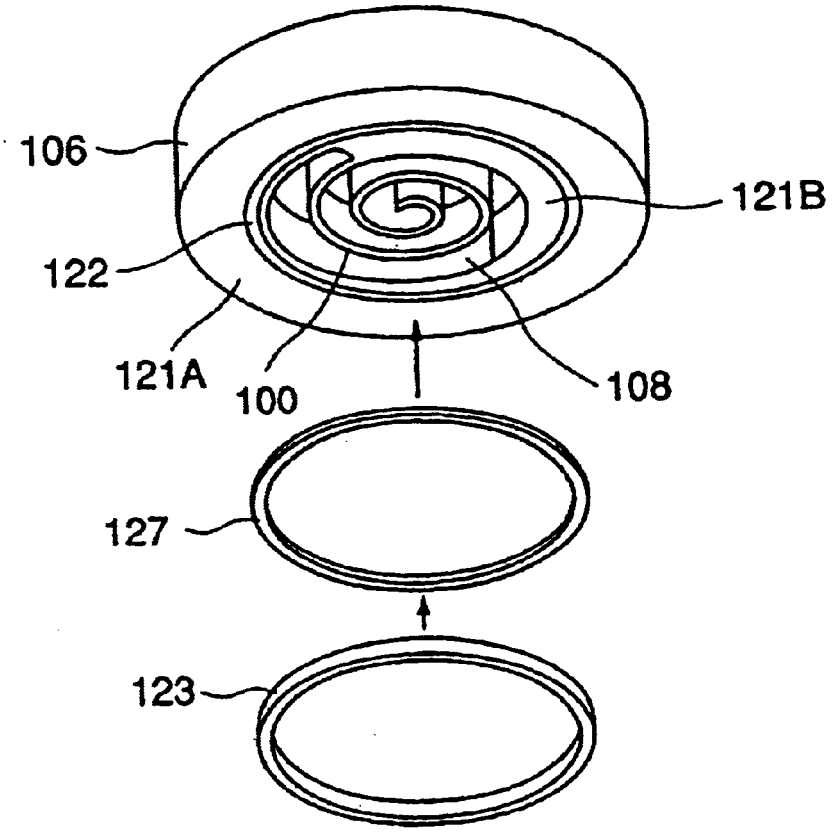
Fig.12(a) PRIOR ART
FIG. 12 is an exploded view and a partial sectional view showing the construction of a scroll fluid machine of the prior art.
Figure 12B:
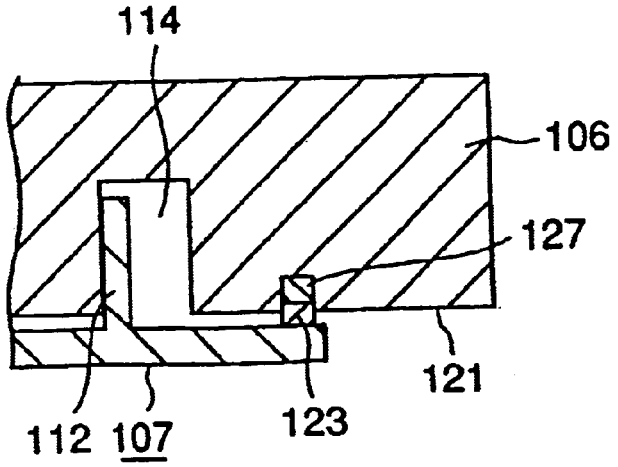
Fig.12(b) PRIOR ART

FIG. 1 is a schematic plan view of a first embodiment of the revolving scroll according to the present invention. FIG. 2 illustrates cross-sectional views along line D—D and line D'—D' in FIG. 1. FIG. 3 illustrates a chip seal disposed in a chip seal groove. FIG. 4 illustrates a meshing state of a revolving scroll lap and stationary scroll lap. FIG. 5 illustrates meshing states for explaining the compression process by the revolving scroll and stationary scroll. FIG. 6 illustrates meshing states for explaining the compression process by the revolving scroll and stationary scroll. FIG. 7 is a schematic plan view of another embodiment of the revolving scroll according to the present invention. FIG. 8 illustrates a meshing state of a revolving scroll lap and stationary scroll lap. FIG. 9 illustrates a chip seal of another embodiment disposed in a chip seal groove. FIG. 10 is a cross-sectional view of a scroll fluid machine. FIG. 11 is a plan view of a scroll fluid machine. FIG. 12 is an exploded view and a partial sectional view showing the construction of a scroll fluid machine of prior art.

As shown in FIG. 10, a scroll fluid machine 1 is composed of a stationary scroll 11, a stationary scroll housing 13 attached under the stationary scroll 11, and a revolving scroll 12 (A,B) located in the inside space and connected to a driving shaft 3(not shown) for rotation. The stationary scroll 11, the housing 13, and the revolving scroll 12 are made of metal such as aluminum, etc.

The stationary scroll 11 is, as shown in a plan view of FIG. 11, shaped like pentagon, an outlet port 16 for letting out the compressed fluid is provided on a land 11*b* located in the center part, inlet ports 11*e* and 11*f* are provided on lands 11*j* and 11*k* each located in the right and left of the outlet port 16. Three bosses 11*m* are positioned in the same distance from the outlet port 16, where crank mechanisms are mounted to hinder the rotation of the revolving scroll to attain the revolving, or orbiting motion of the revolving scroll.

Cooling fins 23 are provided between each land, boss, and perimeter. There are mounting eyes 11*n* for thread to fix the stationary scroll 11 to the scroll housing 13.

In FIG.10, the outer race of a bearing 8 and 9 are fitted in a eye 11*g* at the boss 11*m*. The journal 22 of a crank is fitted in the inner race of the bearing 8 and 9, the journal 22 being tightened by a thread 38 via a retainer 20.

A discharge port 11*d* communicating to the outlet port 16 for discharging the compressed fluid is provided in the center of the sliding surface 11*c* of the stationary scroll. A stationary scroll wrap 11*a* beginning from near the discharge port lid is embedded on the sliding surface 11*c*.

A chip seal 34 having a self-lubricating property is provided on the top face of the wrap 11*a*. The chip seal 34 is preferably made of elastic resin material of superior anti-wear, anti-friction property, for example, fluorine group resin such as polytetrafluoroethylene(PTFE), or polyethersulfan(PES), polyphenylenesulfide(PPS), polyetheretherketone (PEEK), liquid crystal polymer(LCP), polyesphone(PSF), etc.

The inlet port lie and 11*f* are opened in the sliding surface 11*c*. On the outer side of the stationary scroll are formed a lot of fins 23(FIG. 11).

Underside the stationary scroll 11 is screwed a stationary scroll housing 13 having the same outer shape as the stationary scroll in plan view. Inside the stationary scroll housing 13 is formed a room 13*b* which is communicated to the outside through openings 13*f* to allow the outside air to flow in and out.

A motor housing 15 connecting to the stationary scroll housing 13 is formed under the housing 13 in which a motor not shown, having a driving shaft 3 is mounted.

In the room 13 of the stationary scroll housing, the revolving scroll 12 is supported via a bearing 5 for revolving motion on the eccentric pin of a driving member 4 fixed to the driving shaft 3. The revolving scroll 12 has a revolving scroll lap 12*a* standing erect on its sliding surface 12C, the wrap 12*a* meshing with the stationary scroll lap 11*a*.

On the opposite side face 12*e* of the sliding surface 12*c* of the revolving scroll 12 is formed a plurality of cooling fins 12*f* extending radially from the boss 12*d*. The revolving scroll 12 is cooled by the outside air flowing in from the openings 13*f* of the housing 13.

A chip seal 34 having self-lubricating property is provided on the top face of the revolving scroll wrap 12*a* and a dust seal 36 having self-lubricating property is provided on the top face of the outermost wrap 12*b*.

The revolving scroll 12 has three eyes 12*g* corresponding to the three eyes 119 provided in the bosses 11*m* of the stationary scroll 11, bearings 6 and 7 are fitted in the eye 12*g*, and the crank pin 21 is inserted in the inner races of these bearings. As the crank pin 21 is offset from the center of the crank journal 22 which is supported in the boss 11*g* of stationary scroll 11 via the bearings 8 and 9, the revolving scroll 12 revolves around the center of the driving shaft 3 as the driving shaft 3 rotates.

The thread 37 tightens the inner races of the bearings 6 and 7 to the flat cheek of the stepped part of the crank pin 21 via a retainer 19. Reference number 17 is the crank web of the crank.

The working of the scroll fluid machine thus composed according to the present invention will be explained hereinbelow.

In FIG. 10, when the revolving scroll 12 revolves with the rotation of the motor, the fluid taken in from the inlet port 11*e*, 11*f* is compressed in approximately crescent-shaped enclosed spaces formed by the wraps 11*a* and 12*a*, and discharged from the discharge port 11*d* opened at the center part. The heat generated during the compression is released through cooling fins 12*f* formed on the rear face of the revolving scroll 12 by the medium of the air flowing in from the opening 13*f*, the air being stirred by the revolving of the revolving scroll. The heat is also released through the cooling fins 23(FIG. 11) of the stationary scroll 11.

Next, the chip seal and dust seal disposed in the groove of the revolving scroll wrap shall be explained.

FIG. 1 is a schematic plan view of a first embodiment of the revolving scroll according to the present invention. In the drawing, the revolving scroll 12A is formed like a pan having a bottom face 12*c*, the wrap 12*a* being formed spirally extending toward the center from a point at the inner side of the outer wall 12*b*, 12*b*' of the pan-like shaped revolving scroll 12A.

Three eyes 12*i*, 12*j*, and 12*k* for inserting the bearings 6, 7 of the crank pins 21 are provided at a span of 120° angles, the position of each eye corresponding to that of each eye 11*g* of the stationary scroll 11.

On the top face 42 of the outer wall 12*b*, 12*b*' is formed a dust seal groove 18 from the end part 18*d* near the eye 12*j* to the end part 18*d*' near the eye 12*i* passing through on the wall 12$b'$. On the outer wall 12$b$ and the wrap 12$a$ extending from the outer wall 12$b'$ toward the center is formed a chip seal groove 43 from the end part 43$d$ near the center to the end part 43$d'$ near the eye 12$i$ passing through on the outer wall 12$b$.

A dust seal 36 having self-lubricating and anti-wear property and an elastic element 39 made of rubber for pressing the dust seal 36 from the groove bottom 18$b$, is inserted in the dust seal groove 18, as shown in section C—C.

The chip seal groove 43 is formed, as shown in Section A—A, and B—B, so that the depth L1 at the outer side (Section A—A) is shallower than the depth L3 at the center side (Section B—B), that is, L1<L3, and the groove 43 deepens gradually toward the center side. The chip seal 34 is accordingly formed so that its thickness L2 at the outer side (Section A—A) is sma11er than that at the center side (Section B—B), that is, L2<L4.

On the other hand, at the portion where the dust seal 36 contacts with the chip seal 34, as shown in Section D—D and D'—D' in FIG. 2, the bottom 43$b$ of the chip seal groove 43 may be the same in depth as the bottom 18$b$ of the dust seal groove 18 is as shown in FIG. 2($b$) or the bottom 43$b$ may be shallower than the bottom 18$b$ as shown in FIG. 2($a$) or vice-versa.

Here, the shape of the chip seal 34 will be detailed with reference to FIG. 3.

In the drawing, on the top face 42 of the revolving scroll wrap 12$a$ facing the mating mirror face 11$c$, is machined the groove 43 in which the chip seal 43 mentioned above is inserted.

The chip seal 34 has, as shown in FIGS. 3($a$) and ($b$), projections 44 on the face 34$c$ facing the bottom face 43$b$ of the groove 43 formed by incising at a certain span so that the projections 44 have openings produced by the incision orienting toward the high pressure side 50, that is, toward the right [direction] in FIG. 2.

In this embodiment, the width of the chip seal 34 is made smaller than that of the groove 43 for easing the assembling, and a groove 41 is machined on a face 34$d$ of the chip seal 34. In the groove 41 is fitted a cushion(seal element) 40 made of elastic resin such as silicone, fluorine, nitrile resin. The seal chip 34 is inserted in the groove 43 of the wrap 12$a$ with the cushion 40 fitted in the groove 41.

Although the discharging fluid at the discharge port 11$d$ shown in FIG. 10 pushes up the chip seal 34 from the lower face 34$c$ to make the upper face 34$a$ contact with the mating mirror face to form an enclosed space, when the pressure of the fluid is low, it is difficult to form the enclosed space. In this embodiment, however, the chip seal 34 is forced upward by the elastic force of the projection 44 to secure the forming of the enclosed space, and the leak of the fluid across the wrap 12$a$ is prevented.

When the fluid pressure exerting on the higher pressure side face 34$b$ is higher than that exerting on the lower pressure side face 34$d$, a gap is developed between the wall face 43$a$ (FIG. 1) of the chip seal groove 43 and the side face 34$b$ of the chip seal 34. However, the fluid flowing in through the gap is sealed by the cushion 40 and the fluid does not leak to the enclosed space lower in pressure outside the lower pressure side of the wrap 12$a$. The leak of the flowed-in fluid to the outer end side of the wrap 12$a$ lower in pressure passing through the gap between the bottom face 43$b$ and the face 34$c$ of the chip seal is sealed by the projection 44.

The explanation with reference to FIG. 3 has been done for a revolving scroll; however, the same chip seal as cited above is used in the groove of the stationary scroll wrap.

FIG. 4 shows a plan view of the combination of the stationary scroll lap 11$a$ and revolving scroll wrap 12$a$.

In the drawing, the wrap 11$a$ of the stationary scroll 11 is disposed inside the wrap 12$a$ and outer wall 12$b'$.

The fluid is taken into a taking-in space 45 formed between the stationary scroll wrap 11$a$ and the outer wall 12$b'$ of the revolving scroll 12 from the inlet port 11$e$ and 11$f$ of the stationary scroll 11 as the pressure in the space 45 becomes negative and discharged from the discharge port lid of the stationary scroll 11, according as the revolving scroll 12 revolves.

The working process will be explained with reference to FIG. 5 and FIG. 6.

In FIG. 5($a$), the fluid in a space S1 communicating with the taking-in space 45 is enclosed in an enclosed space S2 (FIG. 5($b$)) formed by the revolving scroll wrap 12$a$ and the stationary scroll wrap 11$a$ owing to the oscillation of the revolving scroll. Then the volume of the enclosed space decreases in the order of S3(FIG. 6($a$)), S4(FIG. 6($b$)), S5(FIG. 5($a$)), S6(FIG. 5($b$)), S7(FIG. 6($a$)) to compress the fluid, and the compressed fluid is discharged from the discharge port 11$d$ when the last compression chamber S8 communicates with the discharge port 11$d$ as shown in FIG. 6($b$).

In FIG. 5($a$), the fluid in a space T1 communicating with the taking-in space 45 is enclosed in an enclosed space T2(FIG. 5($b$)) formed by the revolving scroll wrap 12$a$ and the stationary scroll wrap 11$a$ owing to the oscillation of the revolving scroll. Then the volume of the enclosed space decreases in the order of T3(FIG. 6($a$)), T4(FIG. 6($b$)), T5(FIG. 5($a$)), T6(FIG. 5($b$)), T7(FIG. 6($a$)) to compress the fluid, and the compressed fluid is discharged from the discharge port 11$d$ when the last compression chamber T8 communicates with the discharge port 11$d$ as shown in FIG. 6($b$).

By the way, though the above explanation on this embodiment is done, for the sake of convenience of explanation, discriminating the outer wall 12$b$ and 12$b'$ from the wrap 12$a$, the inside wall face of the outer wall 12$b$ and 12$b'$ and the outer side wall face of the wrap 11$a$ contacts in meshing and the outer wall 12$b$ and 12$b'$ works as outermost wrap of the revolving scroll.

In FIG. 1, the chip seal groove 43 may be formed on the wrap 12$a$ from the end part 18$d'$ to the end part 18$d$ on the outer wall 12$b'$. In this case, the chip seal 34 works also as dust seal.

Next, another embodiment of a revolving scroll according to the present embodiment will be explained with reference to FIG. 7.

The different point from FIG. 1 is: sealing of the outer wall is duplicated by a chip seal and dust seal in FIG. 1, but in FIG. 7 the duplicating parts do not exist.

In FIG. 7, the same constituent element as that in FIG. 1 is denoted with the same reference number. In FIG. 7, the revolving scroll 12B is formed like a pan having the bottom face 12$c$, the wrap 12$a$ being formed spirally extending from a point at the inner side of the outer wall 12$b$, 12$b'$ of the pan-like shaped revolving scroll 12B toward the center.

Three eyes 12I, 12$j$, and 12$k$ for inserting the crank pins 21 are provided at a span of 120° angle, the position of each eye corresponding to that of each eye 11$g$ of the stationary scroll 11.

On the top face 42 of the outer wall 12$b$, 12$b'$ is formed a dust seal groove 18 as shown in Section F—F in FIG. 7. On the wrap 12$a$ extending from the outer wall 12$b$, 12$b'$ toward the center is, as shown in Section E—E, G—G, formed a chip seal groove 43 from the end part 43*d* near the center to the end part 43*d*' near the eye 12*j*.

A dust seal 36 having self-lubricating and anti-wear property and an elastic element 39 made of rubber for pressing the dust seal 36 from the groove bottom 18*b*, is inserted in the dust seal groove 18, as shown in section F—F.

The chip seal groove 43 is formed, as shown in Section E—E, and G—G so that the depth L1 at the outer side is shallower than the depth L3 at the center side, that is, L1<L3 and the groove 43 deepens gradually toward the center side. The chip seal 34 is accordingly formed so that its thickness L2 at the outer side is sma11er than that at the center side, that is, L2<L4.

On the other hand, at the portion where the dust seal 36 contacts with the chip seal 34 or verge on the same with a permissible gap, as shown in Section D"—D" in FIG. 2, the bottom 43*b* of the chip seal groove 43 may be the same in depth as the bottom 18*b* of the dust seal groove 18 is as shown in FIG. 2(*b*) or the bottom 43*b* may be shallower than the bottom 18*b* as shown in FIG. 2(*a*) or vice-versa.

The shape of the chip seal 36 is the same as detailed in FIG. 3. The dust seal 34 is of the same material as that in FIG. 1. The dust seal 34 may be of ring shape without a joint, or one or a plurality of adequate length may be inserted in the groove 18.

FIG. 8 shows a plan view of the combination of the stationary scroll lap 11*a* and revolving scroll wrap 12*a*. In the drawing, the wrap 11*a* of the stationary scroll 11 is disposed inside the wrap 12*a* and outer wall 12*b*'.

The fluid is taken into a taking-in space 45 formed between the stationary scroll wrap 11*a* and the outer wall 12*b*' of the revolving scroll 12 from the inlet port 11*e* and 11*f* of the stationary scroll 11 as the pressure in the space 45 becomes negative and is discharged from the discharge port 11*d* of the stationary scroll 11, as the revolving scroll 12 revolves.

The working process is the same as that with the revolving scroll of FIG. 1 explained with reference to FIG. 5 and FIG. 6, and so explanation of this process is omitted.

By the way, though the above explanation on this other embodiment is done, for the sake of convenience of explanation, discriminating the outer wall 12*b* and 12*b*' from the wrap 12*a*, the inside wall face of the outer wall 12*b* and 12*b*' and the outer side wall face of the wrap 11*a* contact by meshing and the outer wall 12*b* and 12*b*' works as outermost wrap of the revolving scroll.

In FIG. 7, the chip seal groove 43 may be formed on the wrap 12*a* extending from the end part 43*d*' to the outer wall 12*b*. In this case, the chip seal 34 works also as dust seal.

FIG. 9 shows another embodiment of a chip seal disposed in the chip seal groove. In the drawing, FIG. 9(*a*) shows the case in which a columnar seal element 46A with circular section made of elastic material is used for the cushion(seal element)40 in FIG. 3(*a*) of the chip seal 34 which is inserted in the chip seal groove 43, and FIG. 9(*b*) shows the case in which a seal element of hollow octagon tube 46B is used.

FIG. 9(*c*) shows the case in which a chip seal 27 having rectangular section is used instead of the chip seal 34 having the seal element 46. The chip seal 27 has projections 28 on the face 27A facing the bottom face 43*b* of the groove 43 formed by incising at a certain span so that the projections 44 have openings produced by the incision orienting toward the high pressure side 50, the projections 44 exerting elastic force against the bottom face 43*b*, and also has on the higher pressure side face 27*c* projections 29 having elastic pushing force formed by incising the face 27*c* at a certain span so that the projections 44 have openings produced by incision orienting toward the high pressure side 50.

Although the chip seal 27 is pushed up by the fluid pressure under the bottom face 27A and the upper face 27B contacts with the mating mirror face to form an enclosed space, when the fluid pressure is low, it is difficult to form the enclosed space. In the embodiment, however, the chip seal 27 is forced upward by the elastic force of the projection 28 to secure the forming of the enclosed space, and the leak of the fluid across the lap 11*a*(12*a*) is prevented.

As the side face 27D of the chip seal 27 is brought in intimate contact with the groove wall by the pushing force of the projections 29 even when the fluid pressure on the higher pressure side 27C is small, the leakage of the compressed fluid to the lower pressure side through passing the gap between the bottom face 43*b* of the groove 43 and the lower face 27A of the chip seal 27 is prevented.

In this embodiment, the chip seal groove 43 shown in FIG. 1 and FIG. 7 is formed so that the depth L1 at the outer side is shallower than the depth L3 at the center side, that is, L1<L3 and the groove 43 deepens gradually toward the center side, and the chip seal 34 is formed so that the thickness at the outer side L2 is sma11er than the thickness L4 at the center side, that is, L2<L4. However, it is permissible that L1<L3 and L2<L4.

An example in which a dust seal and chip seal are provided in a revolving scroll is explained hitherto. However, another embodiment in which a dust seal and chip seal are provided in a stationary scroll, and a revolving scroll having a chip seal only is driven to revolve, is suitable.

Three crank mechanisms are used for preventing rotation of a revolving scroll in the embodiment. However, oldham couplings can be used.

As the thermal expansion of a seal element is different depending on whether it is in higher pressure zone or lower pressure zone, it is also possible to divide the seal element into a plurality of seal elements having appropriate dimensions and dispose seal elements having different property in consideration of thermal expansion coefficient, anti-wear property, etc.

As explained hitherto, according to the present invention, either one of the stationary or revolving scroll, each scroll having a spiral scroll wrap spiraling from the center side to the outer side, is provided with an annular, outermost wrap of which the radius is larger than that at the outer end of the spiral wrap of the other scroll and the outermost wrap forms the outermost wall of the said one of the scrolls, so the outermost wall has no excess width of rims as is the case with the prior art. The one and the other scrolls are assembled so that the wrap of the said other scroll is disposed in the inner side of the wrap of the said one of the scrolls. Therefore, the scroll mechanism becomes small sized, and the downsizing of the scroll fluid machine is achieved.

Accordingly, the light weight of the constituent elements of the scroll fluid machine is achieved, the load for driving the scroll mechanism is lightened, and the power for driving the scroll fluid mechanism is reduced.

Thus, a higher compression ratio, or a higher pressure ratio, is achieved with the same dimensions of the scroll fluid machine of the prior art.

According to the present invention, the leakage of the compressed fluid between the compression chambers formed by the revolving scroll wrap and the stationary scroll wrap, that is, the leakage from the chamber of higher pressure to that of lower pressure, is prevented, by providing seal elements between the top face of the wraps of the stationary and revolving scrolls and mating sliding surfaces to keep gas-tight between chambers across the wraps, and a high compression ratio, or a high pressure ratio, can be achieved.

Further, as a seal element for sliding surface sealing which contacts with the mating sliding surface is provided on the outermost wrap, the seal element for sliding surface sealing on the outermost wrap achieves the role of sealing dust while at the same time achieving the sealing of fluid without providing an extra dust seal still outside of the outermost wrap.

Accordingly, the light weight of the constituent elements of the scroll fluid machine is achieved, the load for driving the scroll mechanism is lightened, and the power for driving the scroll fluid mechanism is reduced.

Thus, a higher compression ratio, or a higher pressure ratio, is achieved with the same dimensions of the scroll fluid machine of the prior art.

What is claimed is:

1. A scroll fluid machine comprising a stationary scroll and a revolving scroll, each scroll having a scroll wrap spiraling from a center side toward an outer side, and said scroll wrap having a tip seal member received in a groove formed in a tip thereof, wherein part of the spiraling scroll wrap of one of said scrolls extending by a certain length from an outer end part thereof toward the center side forms a first outer wall, and wherein a second outer wall, which has a dust seal member in a groove formed in the tip thereof, extends from said outer end part of the spiraling scroll wrap and surrounds the spiraling scroll wrap to be connected with the spiraling scroll wrap at a position where the spiraling scroll wrap is extended to by a certain length from the outer end part thereof toward the center side, so that the second outer wall and the first outer wall together form an outermost wall or wrap, wherein said tip seal member is provided with a cushion seal member received in a groove formed in a lower pressure side thereof; wherein an elastic element is provided under said dust seal member on a bottom of the groove formed in the tip of the second outer wall, and wherein said cushion seal member contacts the side face of said dust seal member.

2. The scroll fluid machine according to claim 1, wherein each of said spiraling scroll wraps including the first outer wall and said second outer wall is provided with a groove formed in a tip thereof, wherein a dust seal member is received in the groove formed in the tip of the second outer wall, and wherein side faces of both seal members face each other at sections where the second outer wall connects with the first outer wall of the spiraling scroll wrap.

3. The scroll fluid machine according to claim 1, wherein a thickness of said tip seal member is greater in the center side than in the outer side of the spiraling scroll wrap.

4. The scroll fluid machine according to claim 3, wherein a thickness of said tip seal member is in a direction of groove depth.

5. The scroll fluid machine according to claim 1, wherein the lower pressure side is an outer side.

6. A scroll fluid machine comprising a stationary scroll and a revolving scroll, each scroll having a scroll wrap sprialing from a center side toward an outer side, and said scroll wrap having a tip seal member received in a groove formed in a tip thereof, wherein part of the spiraling scroll wrap of one of said scrolls extending by a certain length from an outer end part thereof toward the center side forms a first outer wall, and wherein a second outer wall, which has a dust seal member in a groove formed in the tip thereof, extends from said outer end part of the spiraling scroll wrap, and surrounds the spiraling scroll wrap to be connected with the spiraling scroll wrap at a position where the spiraling scroll wrap is extended to by a certain length from the outer end part thereof toward the center side, so that the second outer wall and the first outer wall together form an outermost wall or wrap, wherein side faces of both seal members face each other at sections where the second outer wall connects with the first outer wall of the spiraling scroll wrap, and wherein a thickness of said tip seal member is greater in the center side than in the outer side of the spiraling scroll wrap.

* * * * *